United States Patent [19]

Beney et al.

[11] Patent Number: 4,472,002

[45] Date of Patent: Sep. 18, 1984

[54] RETRACTABLE BIT GUIDE FOR A DRILLING AND BOLTING SLIDE

[75] Inventors: Gilbert Beney, Meyzieu; Michel Combet, Miribel, both of France

[73] Assignee: Eimco-Secoma Societe Anonyme, Meyzieu, France

[21] Appl. No.: 463,004

[22] Filed: Feb. 1, 1983

[30] Foreign Application Priority Data

Mar. 17, 1982 [FR] France ..... 82 04946

[51] Int. Cl.[3] ..... F16C 1/26; E21C 9/00; E21D 20/00

[52] U.S. Cl. ..... 308/3.9; 175/220; 173/141

[58] Field of Search ..... 308/3.9; 175/220, 122, 175/173, 209; 173/141, 86, 39

[56] References Cited

U.S. PATENT DOCUMENTS

| | | | |
|---|---|---|---|
| 2,314,366 | 3/1943 | Paget | 173/141 |
| 3,149,680 | 9/1964 | Downend | 173/39 |
| 3,967,686 | 7/1976 | Fögelström | 308/3.9 X |
| 4,105,081 | 8/1978 | Perraud | 175/122 |
| 4,300,642 | 11/1981 | Perraud | 175/209 X |
| 4,402,557 | 9/1983 | Paasonen et al. | 308/3.9 |

FOREIGN PATENT DOCUMENTS

| | | | |
|---|---|---|---|
| 105987 | 5/1917 | United Kingdom | 308/3.9 |

*Primary Examiner*—Stuart S. Levy
*Assistant Examiner*—Thomas R. Hannon
*Attorney, Agent, or Firm*—Karl F. Ross; Herbert Dubno

[57] ABSTRACT

The body of a bit guide assembly is mounted on a base which pivots on a frame about a first pivot point and may thus be retracted in order to allow the passage of the anchoring bolt screwed after drilling a hole. A double-acting jack has its rod pivoted on the base, whereas its body is pivoted on a dog, in turn mounted to pivot on the frame about a second pivot opposite the pivot point. The dog comprises a locking tooth which cooperates with the end of the base remote from the first pivot point. The free end of the dog cooperates with a retaining tooth formed on a connecting-rod, mounted to pivot about a fixed pin and biased by a spring against a stop. The same jack thus controls the retraction of the bit guide, for bolting and its locking in the lowered position, for drilling.

10 Claims, 3 Drawing Figures

RETRACTABLE BIT GUIDE FOR A DRILLING AND BOLTING SLIDE

CROSS REFERENCE TO RELEVANT APPLICATIONS

While this application is not directly related to any specific prior applications, work of the present assignee has resulted in a number of applications and patents in this field which may be considered relevant or material. These applications include Ser. No. 161,419 filed June 20, 1980, Ser. No. 190,165 filed Sept. 23, 1980 as a continuation-in-part of Ser. No. 947,322 of Oct. 2, 1978, and Ser. No. 199,683 of Oct. 22, 1980. U.S. patents which may likewise be considered to be relevant are U.S. Pat. Nos. 4,105,081, 4,291,771, 4,326,499 and 4,300,642.

FIELD OF THE INVENTION

The present invention relates to a retractable bit guide for a drilling and bolting slide.

BACKGROUND OF THE INVENTION

In subterranean engineering, i.e. the construction of tunnels, galleries or shafts, it is frequently desirable to stabilize the excavated structure by anchoring wall or support members thereto and, for this purpose, drilling and bolting machines have been developed as, for example, will be apparent from the aforementioned applications and patents.

The procedure which can be carried out with the aid of such machines involves the drilling of a so-called borehole and the subsequent anchoring of a bolt therein. Frequently the anchoring of the bolt can be effected at least in part by introducing into the hole in which the bolt is inserted, a hardenable synthetic resin mass, especially a thermosetting synthetic resin.

For this procedure therefore, in the field of mining applicances, slides are known which are carried by support arms and along which a carriage operating as a drill and screwing arrangement is able to move, which makes it possible to drill a hole by means of a bit, then to introduce and tighten an anchoring bolt in the hole drilled previously.

During the operation of drilling the hole, the bit passes through a device referred to as a "bit guide", mounted at the front end of the slide. During the subsequent bolting operation, this bit guide must be retracted, in order to clear a sufficient space for the passage of the bolt with its customary bearing plate. To this end, retractable bit guides already exist. Such guides have a body through which the bit may pass and which can be moved by pivoting towards a retracted position, by a mechanism comprising a jack.

In retractable state-of-the-art bit guides of this type, the jack mechanism comprising a jack ensures virtually only a control of the opening and closing movement, but does not produce adequate hydraulic tightening in the closed position, for drilling, owing to the small lever arm, in part caused by the need to make the device as small as possible. The necessity of clearing a sufficient space for the passage of bolts provided with their plate, when the bit guide is retracted, makes it impossible to install in this space a jack which can ensure good locking. The result is that in earlier bit guides, the retraction function is the only function ensured and no locking is provided; this constitutes a serious drawback since the bit guides are not held sufficiently firmly in order to withstand the considerable forces transmitted by the bits during drilling.

OBJECTS OF THE INVENTION

It is the principal object of the present invention to provide an improved bit guide assembly for a drill slide which obviates the aforedescribed disadvantages.

Another object of the invention is to provide a bit guide assembly with an improved retraction mechanism such that reliable locking can be ensured in the operative position of the guide, but displacement thereof into the inoperative position is not adversely affected.

Still another object of the invention is to provide a compact, rapidly functioning and reliable mechanism controlling the locking and retraction of a bit guide in an apparatus of the class described and which is capable of securely locking the guide with a minimum of parts.

SUMMARY OF THE INVENTION

These objects and others which will become apparent hereinafter are attained, according to the invention, in a bit guide assembly forming part of a drilling slide of the aforedescribed type which comprises a support, a drilling guide swingable on said support and having a free end remote from its pivot, a single piston-and-cylinder arrangement operatively connected to the guide for swinging same about said axis from its operative position to an inoperative or retracted position, and a locking pawl swingably mounted on the support and engageable with said free end to latch the guide in its operative position, but coupled with the cylinder arrangement to release the guide so that it can be swung into its inoperative position.

Thus only a single hydraulic jack is required for both locking and carrying out the retraction movement.

According to the present invention, therefore, there is provided a retractable bit guide assembly for a drilling and bolting slide, comprising a body through which the bit may pass and which is able to be moved by pivoting towards a retracted position, by means of a mechanism comprising a double acting jack.

The double acting jack is pivoted, by one of its ends, on the base of the bit guide mounted to pivot on a frame about a first pivot point, parallel to the slide and is pivoted, by its other end on a dog or pawl mounted to pivot on the frame about a second pivot point located opposite the first pivot point of the aforesaid base, the dog comprising, close to the second pivot point, a locking tooth able to cooperate with the end of the base remote from the first pivot point of the latter, whereas the free end of this dog is able to cooperate with a part mounted to pivot about a fixed pin on the frame, which part is subject to the action of a spring and comprising a tooth for retaining the free end of the dog, in the unlocked position.

Preferably, the said pivoting part is a connecting or link plate, having one end pivoted to the frame, whereas its other end, comprising the retaining tooth for the dog, is connected to a first end of a coil spring whereof the second end is fastened at a fixed point of the frame, pivoting of the connecting plate being limited in one direction by a stop.

Advantageously, the frame is constructed in the form of a box, enclosing the double acting jack, the dog, the connecting-rod and the spring. An anchoring point may be mounted on the front face of this casing.

In the closed position, the same jack, acting simultaneously on the pivoting base of the bit guide and on the dog, keeps this base in the lowered position and locks it in this position through the intermediary of the dog. It should also be noted that the locking tooth of the dog bears on the base at a point though remote from the pivot point of this base, thus with a considerable lever-arm, which makes it possible to withstand the high forces applied by the bit to the bit guide.

For the retraction of this bit guide, the jack supplied with fluid in the suitable direction simultaneously brings about tilting of the dog, thus unlocking and pivoting of the bit guide in the direction for raising it.

In the position of maximum opening, the dog is retained by the notch of the connecting plate or keeper, subject to the action of the spring. In order to obtain closing of the bit guide the jack is supplied with fluid in the opposite direction. Taking into account the force to be overcome in order to release the dog from the tooth of the keeper, one is assured that the jack will first of all bring about the return of the bit guide into its lowered position and then solely tilting of the dog which which reestablish locking. It is thus that single double-acting jack in order to carry out the functions of opening/closing and locking, with synchronization being obtained automatically. The control device thus remains very simple and it occupies a small space.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
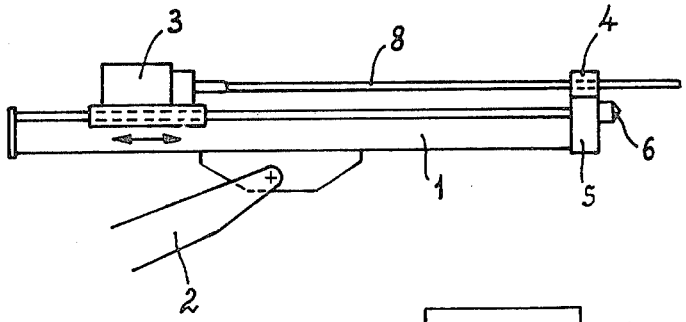
FIG. 1 is a diagrammatic side view of a slide provided with a bit guide assembly according to the invention.

FIG. 1 shows a drilling and bolting slide 1, mounted at the end of a support arm 2. A carriage 3 operating as a drill and bolt-setting (threading) arrangement is able to move along the slide 1. The bit guide assembly 4 is supported by a support in the form of a casing 5, enclosing its control mechanism, which is in turn mounted at the front end of the slide 1. The front face of the casing 5 supports an anchoring point 6. In the so called closed or operative position, the axis 7 of the bit guide coincides with that of the drill 3 and the bit guide 4 may effectively guide the bit 8 pushed by the carriage 3.

Figure 3:
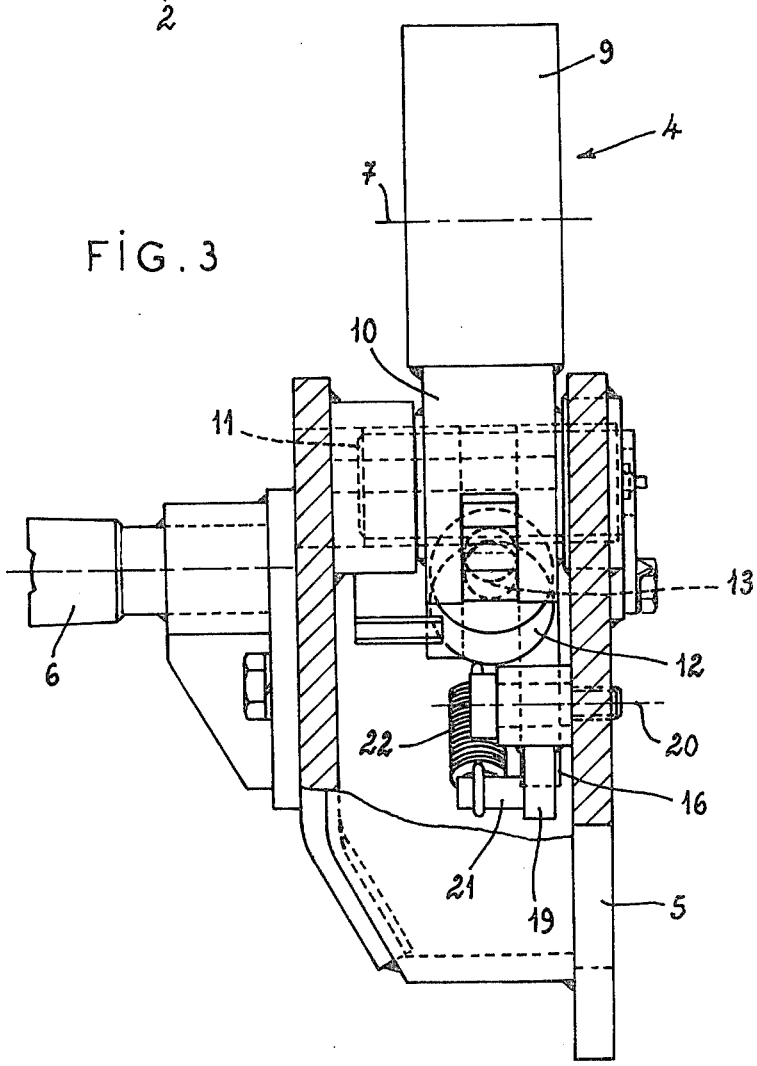
FIG. 3 is a side view, with partial sections, corresponding to FIG. 2.
Figure 2:
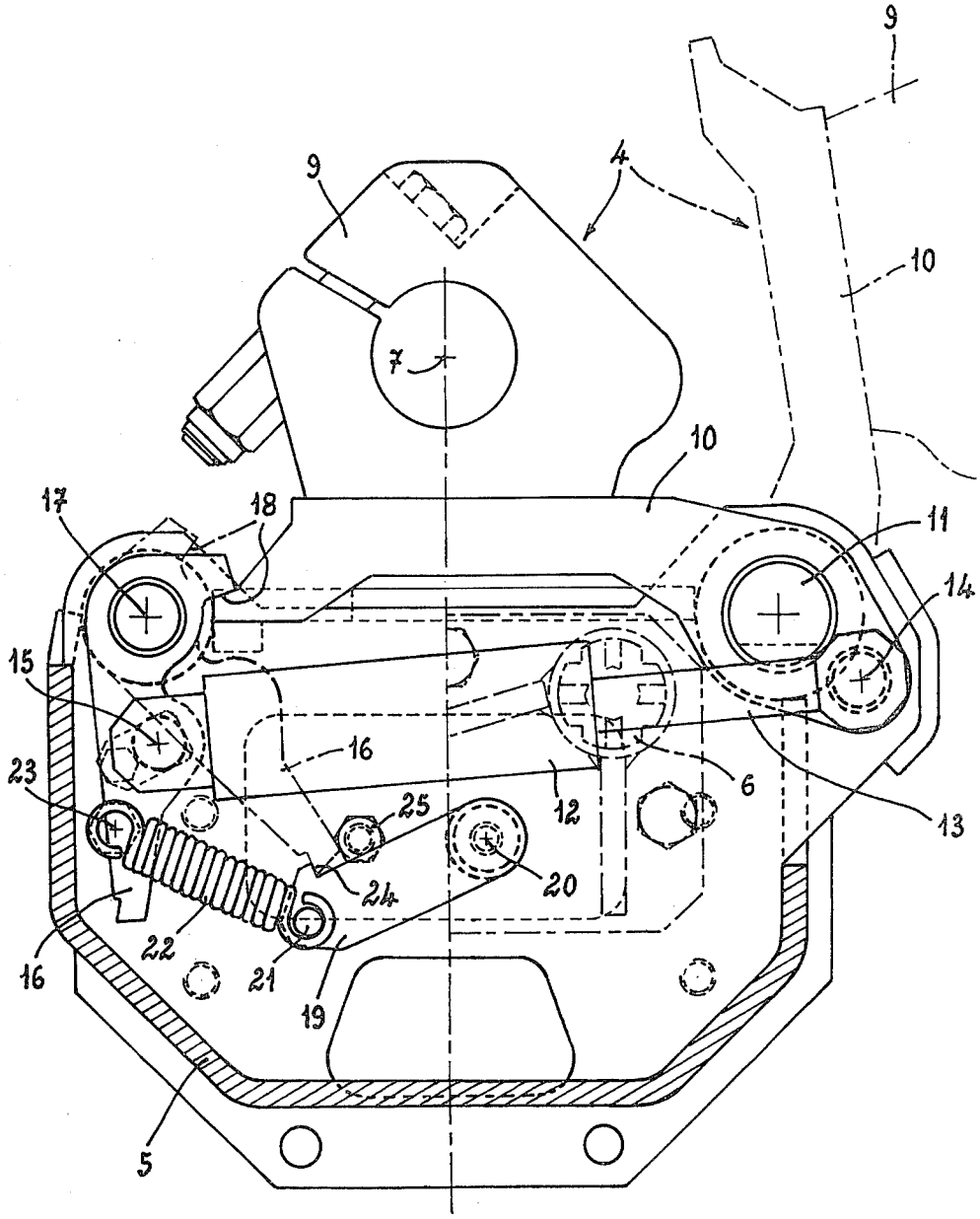
FIG. 2 is a front view, with partial sections, of the bit guide in the closed position, with a rough indication of the retracted position.

As shown in FIGS. 2 and 3, this bit guide assembly 4 comprises a split member 9 through which may pass the bit 8 and of a base 10 mounted to pivot on the casing 5 about a pivot point 11, parallel to the axis 7. The member 9 and base 10 form the bit guide.

Housed inside the casing 5 is a double-acting hydraulic jack 12, the rod 13 of which is pivoted, at a pivot 14, on a clevis-shaped part of the base 10 of the bit guide 4. The body of the jack 12 is pivoted, at a pivot 15, on a dog 16 in turn mounted to pivot on the casing 5 about a pivot point 17, located opposite the pivot point 11 of the base 10. Close to its pivot axis 17, the dog 16 comprises a tooth 18 able to cooperate with the end of the base 10 remote from the pivot point 11.

A keeper plate 19, located below the jack 12, has one of its ends pivoted about a fixed pin 20, whereas its opposite end comprises a lug 21 to which one end of a coil spring 22 is attached. The other end of the spring 22 is fastened at a fixed point 23. At its end comprising the lug 21, the keeper 19 also comprises a tooth 24 able to cooperate with the free end of the dog 16. Finally, a screw 25 serves as a stop for the keeper 19.

In the closed position, corresponding to the solid lines of FIG. 2, the double-acting jack 12 is kept under pressure so that its rod 13 is extended. This jack acts simultaneously on the base 10 of the bit guide which is kept in the lowered position and on the dog 16, the tooth 18 of which is thus applied against the end of the base 10 remote from the pivot point 11, which ensures locking of the bit guide. The keeper 19, which does not take part in this locking position, remains in abutment against the stop screw 25 under the action of the spring 22.

In order to retract the bit guide, the jack 12 is supplied with fluid in the direction for retracting its rod 13. By retracting, the jack 12 simultaneously raises the base 10, which pivots about the pivot point 11 and the tooth 18 of the dog 16, the latter tilting about the pivot 17. The bit guide and the dog 16 pivot as far as their final open position shown in dot dash lines in FIG. 2. During the pivoting of the dog 16, the free end of the latter pushes the connecting-rod 19 slightly downwards, before engaging behind the tooth 24 of said connecting-rod 19 which thus once more bears against the stop screw 25 under the action of the spring 22. The dog 16 is held in the unlocked position.

In order to obtain the closing of the bit guide from the previously described open position, the jack 12 is supplied with fluid in the direction of extension of its rod 13. The hydraulic pressure required to lower the base 10 of the bit guide 4 is much less than that necessary for releasing the dog 16 from the tooth 24 of the keeper 19. One is thus certain firstly of lowering the base 10, then of lowering the tooth 18 of the dog 16 onto the end of the base 10 already lowered. This final movement of the dog 16, accompanied by a slight movement of the keeper 19, reestablishes locking of the bit guide in its closed position.

We claim:

1. A bit guide assembly for a drilling and bolting machine adapted to guide a drill bit in an operative position and adapted to clear a bolt in a retracted position, said assembly comprising:

a support;

a guide body pivotally mounted on said support for swinging displacement between an operative position within an opening formed in said body traversed by a drill bit and a retracted position wherein said body is out of the path of a bolt;

a locking pawl pivotally mounted on said support for swinging movement into and out of engagement with said body for locking said body in its operative position and for clearing said body to enable same to swing into its retracted position;

a double acting jack on said support pivotally connected at one of its ends to said body and at the other of said ends with said pawl whereby hydraulic actuation of said jack displaces a pawl to release said body and swing said body into said retracted position; and a spring loaded keeper on said support engageable with said pawl for retaining same in a position of said pawl whereby it clears said body to enable return of said body into its operative position before said pawl is displaced to lock said body in said operative position.

2. The assembly defined in claim 1 wherein said keeper is an elongated element pivotally connected at one end to said support and formed with a retaining tooth at its opposite end and engageable with said pawl, said keeper being provided with a coil spring having one end connected to the opposite end of said element, said spring being connected at its other end to said support, said support being provided with a stop limiting displacement of said element in one direction.

3. The assembly defined in claim 2 wherein said support is formed as a casing enclosing said jack, said pawl, said keeper and said spring.

4. The assembly defined in claim 3 wherein said casing is formed with an anchoring point enabling said assembly to be anchored against a wall to be drilled and set with a bolt.

5. The assembly defined in claim 4 wherein said body is provided with an elongated base pivoted at one end to said support and connected at said one end of said base to said jack, and a member mounted on said base and formed with an opening adapted to be traversed by said bit.

6. The assembly defined in claim 5 wherein said base is provided at its other end with a finger engageable by said pawl.

7. The assembly defined in claim 6 wherein said pawl comprises a long arm and a short arm extending generally at a right angle to one another and is pivotally connected to said casing at a fulcrum between said arms, said short arm engaging said finger to lock said body in said operative position.

8. The assembly defined in claim 7 wherein said long arm has at its free end a formation engageable by said tooth.

9. The assembly defined in claim 8 wherein said jack is pivotally connected to said pawl at a location between said formation and said fulcrum.

10. The assembly defined in claim 9 wherein said stop is a screw in said casing.

* * * * *